US009568292B2

(12) United States Patent
Gevedon

(10) Patent No.: US 9,568,292 B2
(45) Date of Patent: Feb. 14, 2017

(54) AMMUNITION HAVING SPECIALIZED RANGE

(71) Applicant: Hanners Gevedon, Mount Vernon, KY (US)

(72) Inventor: Hanners Gevedon, Mount Vernon, KY (US)

( * ) Notice: Subject to any disclaimer, the term of this patent is extended or adjusted under 35 U.S.C. 154(b) by 279 days.

(21) Appl. No.: 14/466,956

(22) Filed: Aug. 23, 2014

(65) Prior Publication Data

US 2016/0258728 A1 Sep. 8, 2016

Related U.S. Application Data

(60) Provisional application No. 61/870,260, filed on Aug. 27, 2013.

(51) Int. Cl.

| | |
|---|---|
| ***F42B 10/00*** | (2006.01) |
| ***F42B 12/58*** | (2006.01) |
| ***F41A 7/10*** | (2006.01) |
| ***F41A 9/28*** | (2006.01) |
| ***F41A 17/02*** | (2006.01) |
| ***F41A 17/04*** | (2006.01) |
| ***F41A 19/01*** | (2006.01) |
| ***F41A 19/53*** | (2006.01) |
| ***F41C 3/14*** | (2006.01) |
| ***F41C 23/10*** | (2006.01) |

(52) U.S. Cl.

CPC ..... *F42B 12/58* (2013.01); *F41A 7/10* (2013.01); *F41A 9/28* (2013.01); *F41A 17/02* (2013.01); *F41A 17/04* (2013.01); *F41A 19/01* (2013.01); *F41A 19/53* (2013.01); *F41C 3/14* (2013.01); *F41C 23/10* (2013.01)

(58) Field of Classification Search

USPC ..... 102/438, 439, 501

See application file for complete search history.

(56) References Cited

U.S. PATENT DOCUMENTS

| | | | | |
|---|---|---|---|---|
| 3,680,485 A * | 8/1972 | Zaid | ..... | F42B 5/035 102/438 |
| 2012/0234198 A1* | 9/2012 | Carmel | ..... | F42B 30/02 102/438 |

* cited by examiner

*Primary Examiner* — J. Woodrow Eldred

(74) *Attorney, Agent, or Firm* — Chris Tanner, Esq.; TannerPatent.com

(57) ABSTRACT

A round of ammunition including projectiles formed in a stack and having an offset center of mass. Upon discharge, the projectiles are subject to a complex flight path and increased drag, providing advantages in controlling pattern and depth of penetration at a distance.

19 Claims, 10 Drawing Sheets

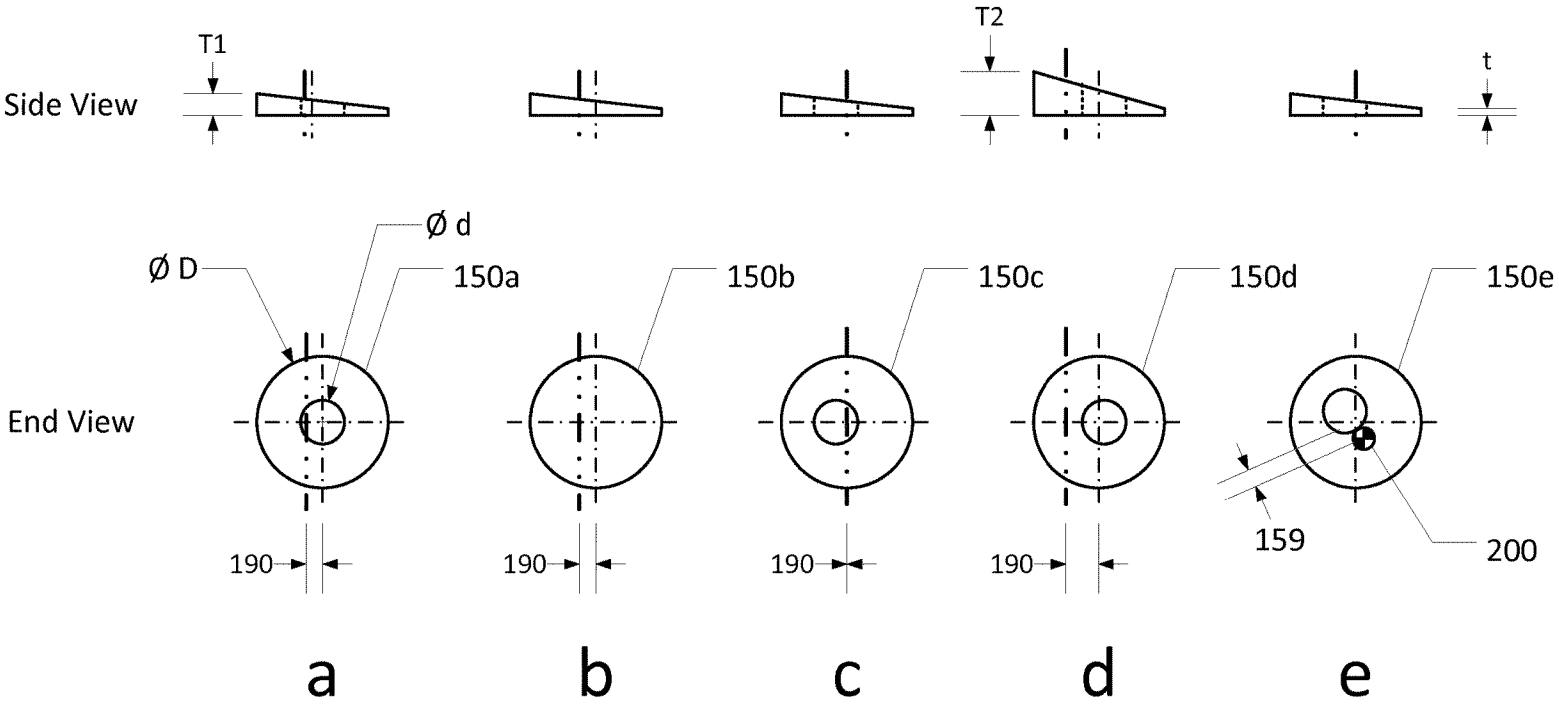
Figure 3 (a – e)

| Test # | 1 (a-b) | 2 (a-b) | 3 | 4 |
|---|---|---|---|---|
| Key Variable | Marking Powder v. No Powder | Center Hole v. Offset | Taper Thickness | Powder Charge |
| Projectile Dia. (in.) | 0.33 | 0.33 | 0.33 | 0.33 |
| Projectile Hole Dia. (in.) | 0.108 | 0.108 | 0.108 | 0.108 |
| Projectile Thickness (in.) | 0.025 x 0.015 | 0.025 x 0.015 | 0.050 x 0.030 | 0.025 x 0.015 |
| Hole Offset (in.) | 0.1 | On center to 0.1 | On center to 0.1 | On center to 0.1 |
| Projectile Count | 13 | 13 | 9 | 13 |
| Wad | PTFE | HDPE | HDPE | HDPE |
| Powder Charge | 3.5 grains | 3.5 grains | 3.5 grains | 3.0 grains |
| Marking powder | Yes v. No | No | No | No |

Figure 8

| | fps | x-y Pat. (in.) @ TD 5 ft. | area (in. sq.) | x-y Pat. (in.) @ TD 10 ft. | area (in. sq.) | x-y Pat. (in.) @ TD 20 ft. | area (in. sq.) | PD (in.) |
|---|---|---|---|---|---|---|---|---|
| **Test 1A** | **No marking powder** | | | | | | | |
| 1 | 935 | | | 11 x 14 | 154 | 30 x 36 | 1080 | |
| 2 | 902 | | | 5 x 9 | 45 | 22 x 39 | 858 | |
| 3 | 956 | | | 7 x 9 | 63 | 16 x 26 | 416 | |
| 4 | 883 | | | 6.5 x 8 | 52 | 36 x 37 | 1332 | |
| 5 | 970 | | | 3 x 10 | 30 | 24 x 41 | 984 | |
| **Avg.** | **929.2** | | | | **68.8** | | **934.0** | |
| **Test 1B** | **Marking powder** | | | | | | | |
| 1 | 945 | | | 3.5 x 3.5 | 12 | 28 x 32 | 896 | |
| 2 | 922 | | | 2 x 6.5 | 13 | 18 x 28 | 503 | |
| 3 | 927 | | | 4 x 4 | 16 | 18 x 37 | 666 | |
| 4 | 853 | | | 4 x 6 | 24 | 11 x 27 | 297 | |
| 5 | 1009 | | | 2 x 3 | 6 | 24 x 32 | 768 | |
| **Avg.** | **931.2** | | | | **14.2** | | **626.0** | |
| **Test 2A** | **Centered hole** | | | | | | | |
| 1 | 983 | | | 6 x 7 | 42 | 16 x 20 | 320 | |
| 2 | 957 | | | 3 x 4 | 12 | 12 x 12 | 144 | |
| 3 | 1028 | | | 2 x 4 | 8 | 14 x 18 | 252 | |
| 4 | 1013 | | | 6 x 8 | 48 | 20 x 24 | 480 | |
| 5 | | 1 x 1 | 1 | | | | | 4 |
| **Avg.** | **995.3** | | **NA** | | **27.5** | | **299.0** | |

Figure 9a

| | fps | x-y Pat. (in.) @ TD 5 ft. | area (in. sq.) | x-y Pat. (in.) @ TD 10 ft. | area (in. sq.) | x-y Pat. (in.) @ TD 20 ft. | area (in. sq.) | PD (in.) |
|---|---|---|---|---|---|---|---|---|
| **Test 2B** | | **Hole offset** | | | | | | |
| 1 | 914 | | | 4 x 5 | 20 | 26 x 30 | 780 | |
| 2 | 803 | | | 5 x 5 | 25 | 29 x 30 | 870 | |
| 3 | 1027 | | | 3 x 6 | 18 | 26 x 28 | 728 | |
| 4 | 951 | | | 3 x 7 | 21 | 28 x 32 | 896 | |
| 5 | | | | | | | | 2 |
| **Avg.** | **923.8** | | | | **21.0** | | **818.5** | |
| **Test 3** | | **Increased thickness, 0.1 in. offset** | | | | | | |
| 1 | 898 | | | 3x 5 | 15 | 8 x 14 | 112 | |
| 2 | 898 | | | 4.5 x 4.5 | 20.25 | 19 x 20 | 380 | |
| 3 | 904 | | | 4 x 5 | 20 | 16 x 17 | 272 | |
| 4 | 870 | | | 3 x 6 | 18 | 9 x 13 | 117 | |
| 5 | 917 | | | 3.5 x 5 | 17.5 | 8 x 12 | 96 | |
| **Avg.** | **897.4** | | | | **18.2** | | **195.4** | |
| **Test 4** | | **Less gunpowder** | | | | | | |
| 1 | 953 | | | 4 x 5 | 20 | 16 x 18 | 288 | |
| 2 | 898 | | | 3 x 5 | 15 | 10 x 14 | 140 | |
| 3 | 883 | | | 4.5 x 6 | 27 | 17 x 18.5 | 314.5 | |
| 4 | 920 | | | 3 x 7 | 21 | 11 x 14.5 | 159.5 | |
| 5 | 904 | | | 5 x 6 | 30 | 15 x 17 | 255 | |
| **Avg.** | **911.6** | | | | **22.6** | | **231.4** | |

Figure 9b

AMMUNITION HAVING SPECIALIZED RANGE

BACKGROUND

1. Field of the Disclosure

This disclosure generally relates to a less-lethal projectile device. More particularly, the following relates to an ammunition round capable of lethality as a function of distance.

2. Description of the Related Art

Less-lethal weapons are those that are capable of impeding an attacker without killing them. Less-lethal weapon systems are well known in the art. Examples include some type of blunt force ammunition round. The round is designed to cause pain but not penetrate the skin. It transfers and disperses its kinetic energy into its target. The most common less-lethal ammunition rounds are those fired from a shotgun. The projectiles themselves are contained in a bean-bag form or may be one or more rubberized bullets. A common problem with a bean-bag projectile is short range and limited accuracy. Both the bean-bag projectile and the rubberized bullets are also capable of causing great harm or death if they strike the attacker's body in more vulnerable areas. A further problem associated with any less-lethal round designed to be fired from a shotgun is the lack of portability and maneuverability of the weapon. For example, a typical 12 gauge shotgun has a barrel bore diameter of about 18.5 mm (0.729 in.), a barrel length of 457 mm (18 in.) to 762 mm (30 in.), and an overall weight which may often exceed 3.63 kg (8 lbs.). These large weapons are not practical to carry in many situations.

Smaller weapons, such as handguns, are more portable but limited in less-lethal projectile options due to the smaller bore diameter. For example a .45 caliber projectile, having a bore diameter of about 11.43 mm (0.450 in.), is the largest caliber pistol generally accepted for practical carry. Another example includes a 9 mm projectile, having a bore diameter of 9 mm (0.354 in.). These smaller diameters are too small for practical bean-bag projectiles, although single projectile rubberized bullets are available.

Yet another challenge with weapons equipped with less-lethal ammunition are the occasions when less-lethal ammunition is not adequate to effectively impede an attacker. That is, there are occasions when deadly force is the only practical solution. Attempts to provide both less-lethal and lethal ammunition have been made. In one example for weapons having magazines which hold multiple rounds to be fired in series, the first rounds may be less-lethal, followed by lethal rounds. This may be dangerous for the shooter, however, if the first rounds are required to be lethal. Additionally, if the shooter fires warning shots, then prefers a less-lethal round, he may now be limited to lethal rounds. Alternately, if the shooter becomes confused on which type of round is next to be fired, he may be hesitant to fire the weapon.

Traditional shotguns, such as the aforementioned 12 gauge shotgun, normally are designed for ammunition having multiple projectiles. These are normally spherical pellets sizes to be lethal at an average distance based on kinetic energy of the pellets. For example, a shotgun having "8 shot" ammunition will have a large number of spherical pellets of about 2.29 mm (0.090 in.). Given their low mass (due to low volume), the kinetic energy will be low, resulting in a lethal distance of only a few meters for human attackers, although the large number of pellets will increase the opportunity of striking an attacker. In contrast, a shotgun having "number 2 buckshot" ammunition will have fewer spherical pellets of about 6.86 mm (0.270 in.), resulting in much higher kinetic energy and therefore an increased lethal distance, but less likely to strike an attacker. Due to the limited accuracy of spherical pellets, it is customary to use larger bore shotguns for personal defense to ensure a minimum number of pellets within each ammunition round, thereby increasing the likelihood of striking the attacker.

Smaller weapons such as handguns are more portable but limited in the number of large pellets which may be contained in each round of ammunition. If the pellet size is reduced, the number of pellets will be increased, but with less kinetic energy capable of impeding an attacker. For example, pellets commonly used in a 9 mm cartridge are "12 shot", having a spherical pellet of a mere 1.27 mm (0.040 in.) in diameter. The kinetic energy is so low that such ammunition is not even seriously considered for impeding an attacker.

What is needed is ammunition capable of being less lethal to an attacker at far distance, lethal to an attacker at a controlled distance, and capable of a minimum number of projectiles in smaller weapons.

SUMMARY

An aspect of the present disclosure provides for an ammunition round having a stack of projectiles wherein at least one of the projectiles has an offset center of mass. Upon discharge from a weapon, the projectiles having an offset center of mass will be subject to a complex flight path and increased drag, resulting in reduced target penetration at a distance.

Another aspect of the present disclosure is an ammunition round having a stack of projectiles capable of carrying a marking powder, providing advantages in crime scene investigation.

This, and other aspects of the present disclosure will be described in greater detail below and should not be taken as limiting other portions of the present disclosure.

Features and advantages of the present disclosure will be more understood through the detailed description and in reference to the figures which follow.

BRIEF DESCRIPTION OF THE DRAWINGS

FIGS. 3*a-e* show side views and corresponding end views of various projectiles according embodiments presented herein;

FIG. 8 shows test parameters in accordance with multiple tests; and

FIGS. 9*a* and 9*b* shows test results in accordance with the test parameters of FIG. 8.

DETAILED DESCRIPTION OF THE PREFERRED EMBODIMENTS

It is to be understood that various omissions and substitutions of equivalents are contemplated as circumstances may suggest or render expedient, but these are intended to cover the application or implementation without departing from the spirit or scope of the claims of the present invention. It is to be understood that the present invention is not limited in its application to [the invention] set forth in the following description. The present disclosure is capable of other embodiments and of being used in various applications. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms and "an" herein do not denote a limitation of quantity, but rather denote the presence of at least one of the referenced item.

Figure 1:
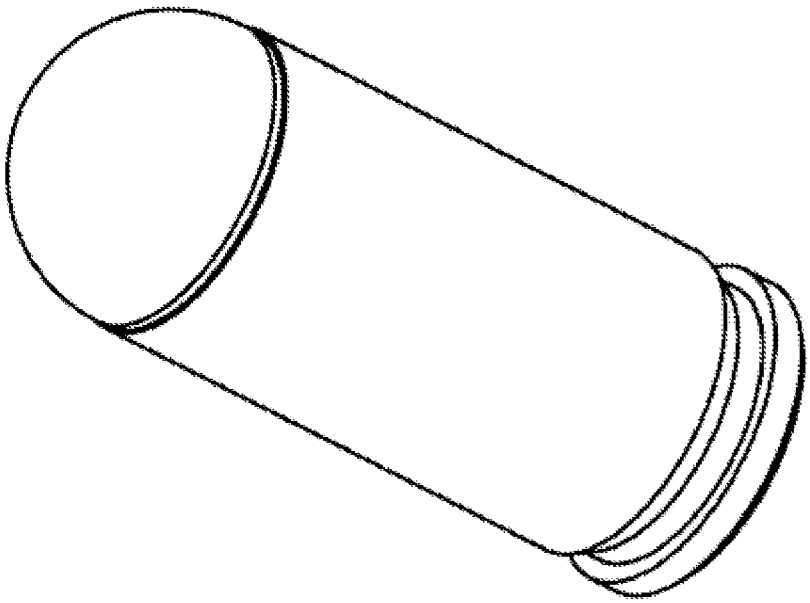
Figure 1 Prior Art
FIG. 1 is a pictorial view of a standard ammunition round.

FIG. 1 shows an exemplary round of ammunition. This is a standard (prior art) configuration designed to function with a standard weapon (not shown). The ammunition provided in this disclosure may appear virtually identical to a standard configuration for compatibility with a standard weapon. The ammunition shown is a .38 caliber, which is a rimless, straight-walled pistol cartridge having a 9 mm (0.355 in.) diameter tip.

It should be noted that a "round" of ammunition may also be called a "cartridge" or "shell", which refers to a complete package including at least a primer, gunpowder, which is also called propellant, and projectile. For most standard ammunition including the .38 caliber, the tip is the projectile.

Figure 2:
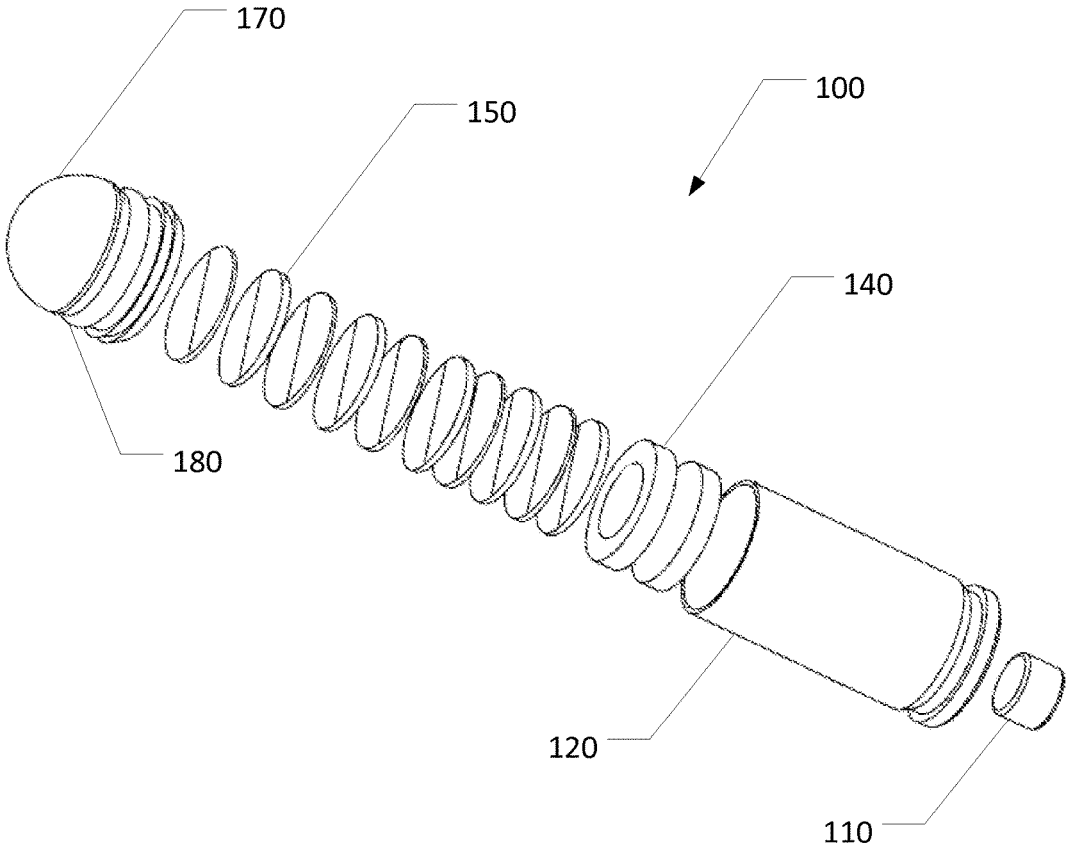
FIG. 2 is an exploded view of the ammunition round according to one embodiment presented herein.

FIG. 2 shows an exploded view of a round of ammunition 100 according to one aspect of the disclosure. The case 120 has a primer 110 press fit into a base portion according to standard configurations. A wad 140 is shown, in addition to several projectiles 150 formed in a stack, and a tip 170 including an O-ring 180. The primer 110, upon being struck with an adequate force, reacts chemically to ignite the gunpowder (not shown in this view). The wad 140 provides a gas pressure seal to ignited gunpowder which provides for controlled expulsion of the tip 170, projectiles 150, and wad 140 from a weapon. The wad 140 may include additional features to control shock (induced by ignited gunpowder), or to contain special features, to be described in upcoming discussion.

Lines shown through each projectile 150 are artifacts of the Computer Aided Drafting (CAD) program, and do not depict particular features.

FIGS. 3*a-d* show varying projectiles 150 (*a-c*) each having a diameter "D" and a taper defined by a greater thickness "T" and lesser thickness "t", and some having a hole diameter "d". Each projectile of FIG. 3*a-d* is shown with a common geometric centerline, and a Mass Centerline (MCL) 190. The MCL 190 describes the center of mass in a two-dimensional plane for simplicity in understanding. By way of example, FIG. 3*a* shows a projectile 150*a* having a taper defined by large thickness "T1", and a hole about the geometric centerline. Since the large thickness "T1" is to the left, the MCL 190 is shown left of the geometric centerline. In FIG. 3*b*, projectile 150*b* is also shown having a taper defined by large thickness "T1", but with no hole. The MCL 190 is also shown left of the geometric centerline. In FIG. 3*c*, projectile 150*c* also has a taper defined by large thickness "T1", and a hole is shown offset (to the left) of the geometric centerline. In this case, the MCL 190 is shown coincident with the geometric centerline, since mass is added to the left by the thicker portion of the taper, but is subtracted from the left by the hole, a net balance results. In FIG. 3*d*, projectile 150*d* has a taper defined by larger thickness "T2" (which is greater than "T1") and a hole offset (to the right) of the geometric centerline. The resulting MCL 190 is substantially left of the geometric centerline, since a substantial mass is added left of the geometric centerline due to "T2", and mass is subtracted to the right of the geometric centerline by the hole.

Now, having described the center of mass in a two-dimensional plane, three-dimensional center of mass, defined as CM 200, will be described by way of FIG. 3*e*. In FIG. 3*e*, the taper is defined by thickness "T1", and a hole is shown left and above the geometric centerline. The resulting three-dimensional center of mass, CM 200, is shown offset from the geometric centerline by offset R, which is the radial distance from the geometric centerline. The common symbol used to depict center of mass (a circle divided into a grid with opposing grids darkened) is used in FIG. 3*e* and shown by CM 200. All projectiles 150 *a-e* will have a three-dimensional center of mass CM 200, although not shown in projectiles 150 *a-d*.

The examples described in FIGS. 3 (*a-e*) show how a projectile 150 may be designed to achieve a CM 200 offset from a geometric centerline with great precision. In testing, a projectile of "dead soft lead" (pure lead) having a diameter of 0.33 in (8.38 mm) was used. A range of alternative projectile 150 materials have been contemplated, including copper, bismuth, tungsten, or any other high density yet soft material or composite.

With precision casting, machining, or forming, a projectile 150 having a CM 200 may be made to have an offset R of less than 15% of the diameter, and up to 70% of the diameter. There is greater mass variation with larger diameters (say, up to 0.50 in. or even up to 0.72 in.), but 15% of the large diameter results in a greater tolerance. With dimensions smaller than 0.33 in. (say, 0.22 in.), there is less mass variation, therefore is also capable of achieving as little as 15% CM 200 radial offset from the geometric centerline. Thus, controlled design parameters of 15% to 70% CM 200 radial offset may be achieved for the above referenced materials over a range of at least 0.22 in. (5.59 mm) to 0.72 in. (18.3 mm) diameter projectiles 150. There are no fundamental reasons currently known that would prevent an outer diameter outside this lower or upper range.

Figure 4B:
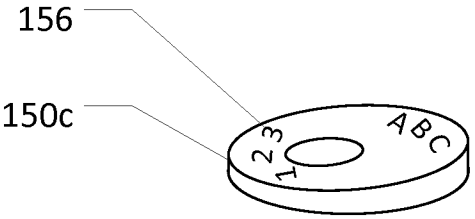
FIGS. 4*a* and 4*b* show pictorial views of projectiles according to embodiments presented herein.
Figure 4A:
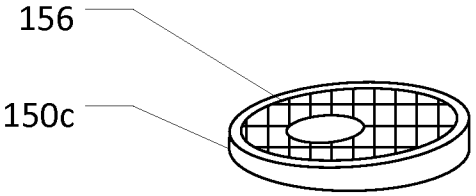

FIG. 4*a* shows a pictorial view of a projectile 150 having a texture 156, depicted by the hatch area shown. At least one textured surface as shown provides engagement of adjacent projectiles, improving the ability for a stack of projectiles 150 to maintain a group formation while passing through the weapon's barrel (not shown) and in the initial moments of flight, improving the ability to control the overall flight pattern of the projectiles 150. The texture may be formed in a mold, may be added after manufacturing, and may be a diamond texture, stippling, dimples, or other types of textures. FIG. 4*b* shows an alternative texture 156, wherein the texture 156 may be an identification mark raised from, or recessed in, the surface. Such a mark may be used, for example, in forensic studies to trace the origins of the ammunition 100, or to positively identify a target which has been marked.

Figure 5B:
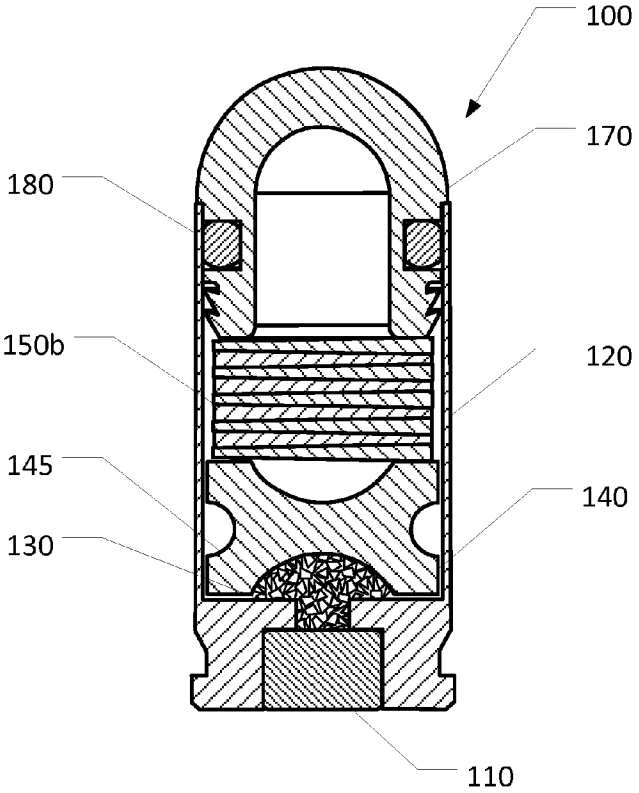
FIGS. 5*a*, 5*b*, and 5*c* show section views of the ammunition according to various embodiments presented herein.
Figure 5A:
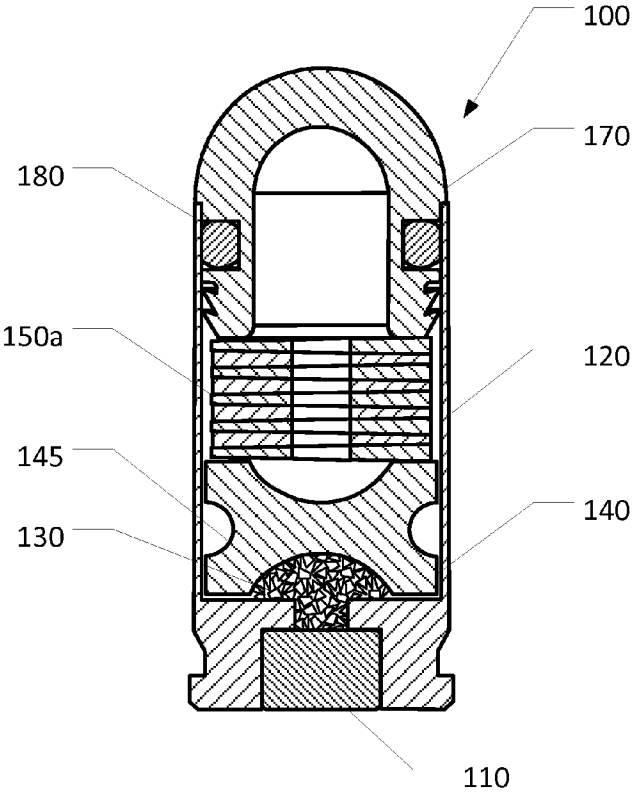
Figure 5C:
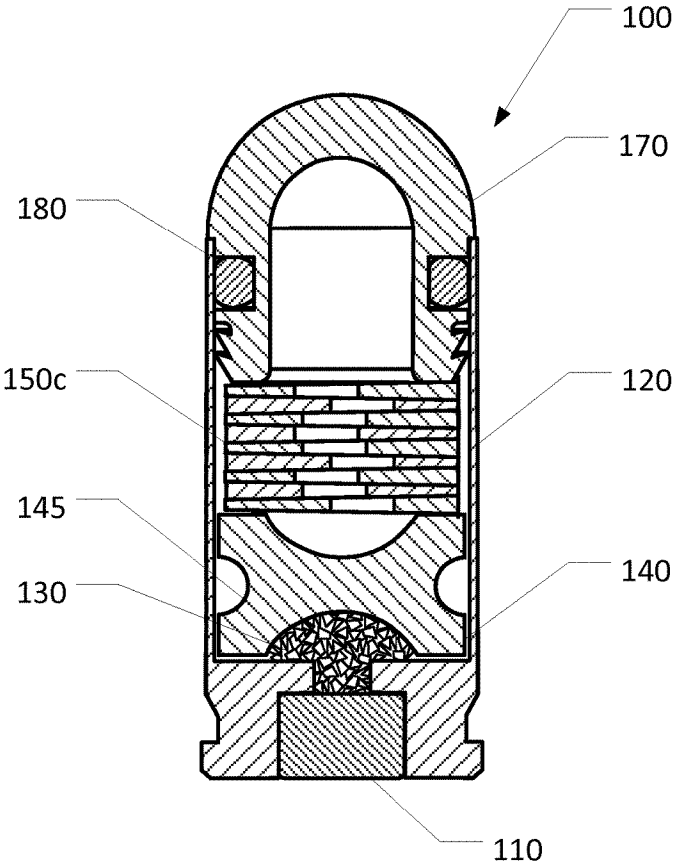

In FIGS. 5*a-c*, the complete round of ammunition 100 according to various aspects of the disclosure is shown, and will be described in the order of assembly. In FIG. 5*a*, ammunition 100 includes a case 120 made of brass, steel, or like material. A primer 110 is pressed into the case 120. A measure of gunpowder 130 is poured into the open end of case 120. In one example to follow, 3.5 grains of Alliant Powder® Unique® is used. A wad 140 is pressed into the case 120. A number of projectiles is placed into the case 120 in a stack. In this example projectiles 150*a*, having holes concentric with the geometric center, are shown. The number of projectiles depends on the thickness of each projectile (such as projectile 150*a*), the length of the case 120, and the gap between the wad 140 and a tip 170. In one example, at stack of 13 projectiles were used. In another example having a greater thickness, 9 projectiles were used. The tip 170 is shown pressed into the case 120. The dimensions are controlled to preferably clamp the stack of projectiles 150 between the wad 140 and the tip 170. Incorporated into the wad 140, there is a wad groove 145 shown. The wad groove 145 reduces the overall mass of the wad 140, and is also designed to provide some compliance (spring effect) to compensate for tolerance variation of the parts build-up from wad 140, through the stack of projectiles 150, to the tip 170.

FIG. 5*b* shows the identical round of ammunition as FIG. 5*a*, except projectiles 150*b* are used in place of 150*a*. Projectiles 150*b* are solid with no hole.

FIG. 5*c* shows the identical round of ammunition 100 as FIGS. 5*a* and 5*b*, except projectiles 150*c* are used in place of 150*a*. Projectiles 150*c* have holes offset from the geometric center. As shown in the assembled cartridge 100, the holes may have varying amounts of offset CM 200, resulting in each projectile 150*c* to be potentially unique in the stack. Thus, each projectile may have inherently different flight characteristics, to be described further.

Projectiles may be common in a single round of ammunition 100, or may use any combination of projectiles 150 *a-e*. For example, in one instance of testing, a .38 Special, having a case length of about 1.16 in. used a stack of nine projectiles of a given thickness, taper, and CM 200. It has been contemplated that in this example, nine different projectiles may be used. There may be one each of projectiles 150 *a, b, c*, one of projectile 150 *d* at a first offset CM 200, one of projectile 150 *d* at a second offset CM 200, and four of projectile 150 *e* at varying offsets CM 200. In a larger round such as a .500 S&W Magnum, which may have a case length of 1.6 inches, twenty or more projectiles may be used in a round. All projectiles may be the same, or may have any combination of thicknesses, tapers, or center of mass (CM) 200.

Projectiles 150 are shown with each having a taper. To form a stack, it is preferred that projectiles 150 be oriented such that a substantially cylindrical column result with the gap between projectiles minimized, as shown in FIGS. 4 *a-c*. This may be accomplished by stacking projectiles 150 having a like taper in pairs, with the tapered surfaces in mating contact, and rotated such that the pair substantially forms a cylinder. It is therefore preferred that an even number of projectiles 150 be used to form a stack, and that for each projectile 150 having a taper, there is a second projectile 150 having a like taper. It should be noted in FIGS. 4 *a-c* that nine projectiles 150 are shown, however, thus demonstrating that an odd number of projectiles 150 may be used.

Figure 6:
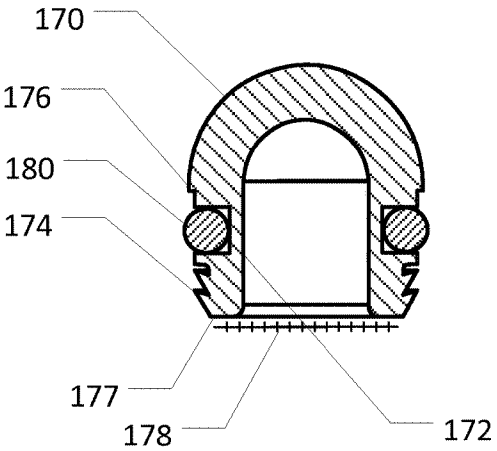
FIG. 6 shows a section view of a tip and O-ring according to embodiments of the disclosure presented herein.

FIG. 6 shows the tip 170 so shaped to receive an O-ring 180. Tip 170 is preferably formed of plastic such as high density polyethylene (HDPE), thermoplastic resin such as Polytetrafluoroethylene (PTFE), and may include reinforced resins such as fiberglass, carbon fiber, or other suitable materials. The tip 170 may be formed by injection molding, machining, or other methods known in the art. If injection molding is used, standard design rules dictate maximum wall thickness (based on material type) to minimize sink marks which may affect sealing into the case. The tip 170 is shown designed for injection molding, having a tip cavity 172 formed from the bottom to maintain proper wall thickness. The O-ring 180 forms a seal against the case 120. Alternately, the tip 170 may include an O-ring shaped feature.

The tip 170 shown in FIG. 6 also includes two ribs 174 designed to form a seal against the case 120 even with slight variations in dimensions. The number of ribs 174, and rib 174 dimensions may vary depending on many design factors. Tip 170 may use ribs 174 and no O-ring 180, one or more O-rings 180 and no ribs 174, or neither O-ring 180 nor ribs 174. If neither, the tip 170 may have a straight or tapered portion so designed to form a friction fit with case 120.

The tip bottom 177 may also include a tip texture 178, as illustrated by the grid line shown. This provides engagement of the tip 170 with the top most projectile 150. Upon discharge from the weapon, projectiles 150 are compressed into tip 170. The diameter of tip 170 is dimensioned to slide against the surface of the weapon's bore, causing a controlled exit from the barrel. If the barrel is rifled (not shown), the tip 170 will engage with the rifling. Further details to follow.

The tip 170 shown in FIG. 6 includes a tip cavity 172, but may also be solid (having no tip cavity) if injection molding sink marks can be tolerated, or if formed by machining, or other such factor. There is also a lip 176 shown. The lip provides a positive positional stop while pressing the tip 170 into the case 120, and insures the tip 170 is fully seated.

FIG. 7, taken from FIG. 5*c*, shows a section view of a round of ammunition including a marking powder 160. The marking powder 160 is shown filling the voids between the wad 140, through the stack of projectiles 150, and into the tip cavity 172. The geometry of the various components will determine the voids available for filling with marking power 160. The texture 156 on projectiles 150 may be so configured to enable more or less marking power 160 in contact with the projectiles 150. The powder may be a colored powder such as a blue, green, or yellow chalk, or may be a powder that fluoresces when illuminated with a UV light source, such as a "black light". One example powder is a green florescent powder, part number 21WGDP, available from The Cary Company in Addison, Ill. It has been contemplated that alternative powders, such as tear gas or powders having concentrations of eye, skin, or breathing irritants may also be used.

Figure 7A:
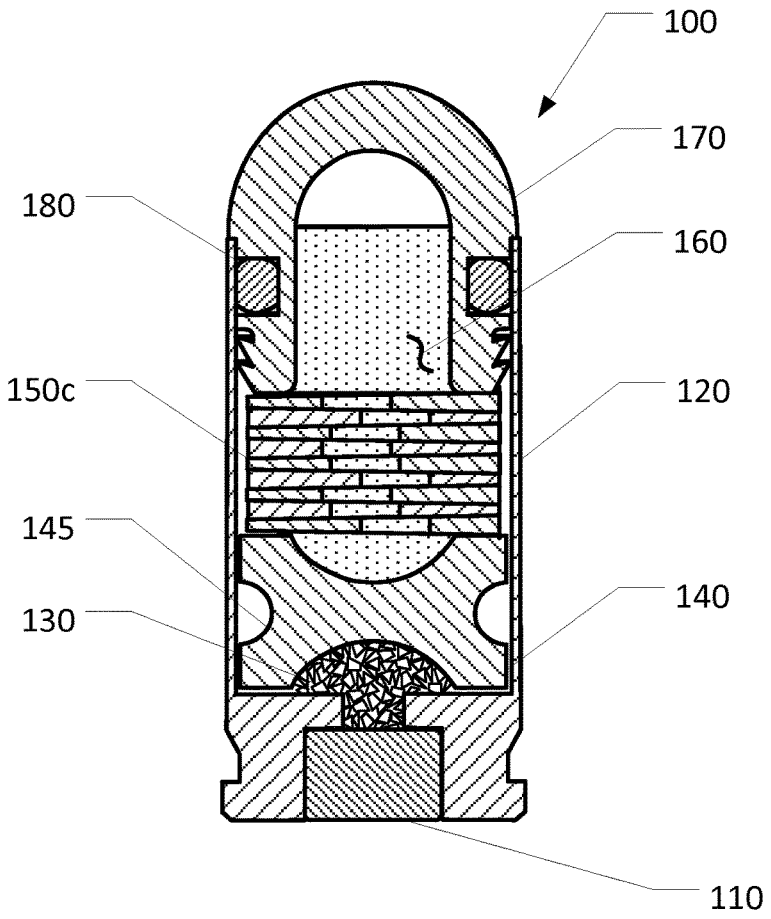
FIG. 7*a* shows a section view of the ammunition according to one embodiment, in addition to a marking powder.
Figure 7B:
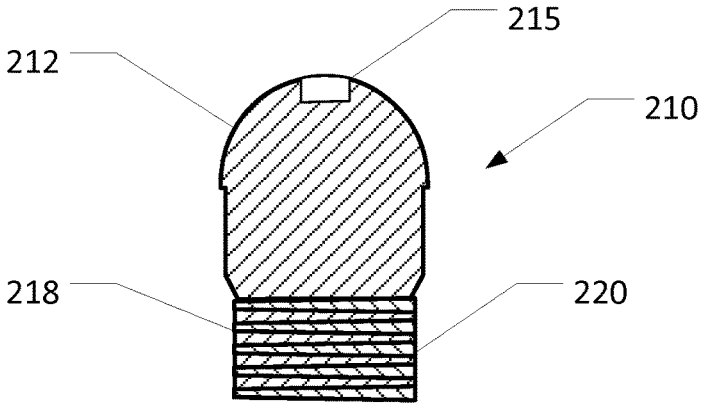
FIG. 7*b* shows an alternative tip.

FIG. 7*b* shows an alternative to tip 170, wherein an integrated projectile tip 210 includes a tip portion 212, and integrated projectiles 218 bonded to the tip portion 212. The integrated projectiles 218 may be a gypsum powder, for example, resin bonded to each other and to the tip portion 212. Bonding occurs at separation layers 220. It has been contemplated that integrated projectiles may form the entire integrated projectile tip 210, which would therefore include bonding at separation layers 220 to the end of tip portion 212. There is also shown a marking powder area 215, which may provide a cavity for marking powder 160. Separation layers 220 between each integrated projectile 218 may be at any angle from vertical to horizontal to angles in-between.

Now with further reference to FIG. 7*a*, a more detailed description of the round of ammunition 100 upon discharge from a weapon will follow. The gunpowder 130, once ignited by the primer 110, creates a high pressure. This high pressure causes the wad 140, the stack of projectiles 150, and the tip 170 to exit the case 120, travel through the barrel, and out the muzzle end (not shown) of the barrel. If the bore is rifled (not shown), the tip will engage with the rifling which will cause the tip 170, in addition to the stack of projectiles 150, to produce a geocentric spin corresponding to the pitch of the rifled barrel. This will ultimately improve the flight characteristics of the projectiles 150.

At some distance from the muzzle end of the barrel, the individual projectiles 150 will separate from the stack, and take on a flight path dictated in part by their shape, CM 200, adjacent projectiles, and environmental factors which affect wind drag. As previously noted with reference to FIG. 5*c*, each projectile may have a different CM 200, resulting in a pattern of projectiles 150 capable of being tuned and controlled within a range of probabilities based on the combined effect of all the afore mentioned variables.

The motion of individual projectiles 150 are capable of spinning, wobbling, tumbling end-over-end, or all of these over the complete travel distance from muzzle to contact with a target. The kinetic energy of each projectile 150 remaining when finally reaching the target will depend in part on the cumulative effects of wind drag, and the motion experienced during flight.

Upon impact with a target, each projectile 150 may impact at an edge, a flat surface, a thin portion of the taper, a thick portion of the taper, or a combination of these. This will occur randomly based on target distance, for example, but the kinetic energy and the overall pattern of impact (such as an area measured by diameter or horizontal and vertical dimensions) at a distance are controlled by the variables described in this text.

If marking powder 160 is used, the high pressure at discharge may cause at least some of the marking powder 160 to penetrate the surface of the projectiles 150, ensuring the marking powder 160 is transferred to a target. This is similar to metallurgical methods for explosive cladding, but in this instance dissimilar materials are bonded (projectiles 150 and marking powder 160) which is in contrast to the traditional metallurgical method. Pre-coating individual projectiles 150 prior to assembly into the case 120 will increase the amount of marking powder 160 available to penetrate the surface of projectiles 150. This is particularly useful for forensic studies to trace the origins of the ammunition 100, or to positively identify a target which has been marked.

The present invention will be more readily appreciated with reference to the examples which follows.

EXAMPLE

Testing has shown that the aforementioned design variables may be optimized to be more lethal to a human target at a near distance, and less lethal to a human target at a greater distance. A description of tests performed is shown in FIG. 8, wherein the following variables are held constant throughout testing: The gunpowder 130 was Alliant Powder® Unique®, Wad 140 dimensions were 0.347 in. diameter×0.125 in. thick, flat with no wad groove 145, the tip 170 was solid High Density Polyethylene (HDPE), case 120 was supplied by R-P Reloads, projectile 150 diameter was 0.33 inches, and projectile 150 material was "dead soft" (pure) lead, hole patterns were random about the centerline.

Also shown in FIG. 8 are the key variables for each test. In summary, Test 1 (a-b) includes testing with and without marking powder 160. Test 2 (a-b) includes testing having holes in projectiles 150 centered about a geometric center and offset. Test 3 varies the taper thickness. Test 4 varies the powder charge relative to Test 2B.

FIG. 9*a* shows test data for Test 1A and 1B, and Test 2A. Test 1A does not include marking powder 160. Test 1B includes marking powder 160. In comparing the velocity of the two tests, the average Test 1A of 929.2 feet per second (fps) is essentially identical to Test 1B at 931.2 fps. The x-y pattern at 10 ft., resulting in a calculated area measured in square inches (in. sq.), shows a substantial difference. In Test 1A, having no marking powder 160, the average pattern is 68.8 in. sq. In Test 2A, having marking powder 160, the average pattern is 14.2 in. sq. The area pattern at 20 ft. averages 934.0 in. sq. for Test 1A (no marking powder 160), compared to 626.0 in. sq. The marking powder 160 assists in the cohesion of the stack of projectiles 150 by filling the area between them & lightly bonding to them as they are discharged. This gives an initial short range cohesion that dissipates as the stack of projectiles 150 break up and disperse.

Test 2A shows results comparing the stack of projectiles 150 having holes formed on the geometric centerline verses Test 2B (shown in FIG. 9*b*) the stack of projectiles having holes offset from the geometric centerline by 0.1 in.

In Test 2A the projectiles 150 averaged 995.3 feet per second versus 932.8 feet per second for test 2B. This is considered within the limits of normal variation due to the hand assembly used in testing. The pattern at 10 ft. showed 27.5 in. sq. for Test 2A versus 21.0 in. sq. for Test 2B. This is also believed to be within the limits of normal variation due to hand assembly. The pattern at 20 ft. shows 299.0 in. sq. for Test 2A versus 673.8 in. sq. It is clear in this case that holes offset from the geometric centerline increased the CM 200 substantially over the CM 200 of Test 2A, resulting in a wider range of flight paths.

Test 3 provides a comparison of projectiles 150 having a greater thickness than those of Test 2B, which is used in this comparison. The velocity of projectile 150 was measured at 923.8 fps in Test 2B versus 897.4 fps in Test 3. This is within the limits of normal variation. The pattern at 10 ft. showed Test 2B to have a pattern of 22.5 in. sq. versus 18.2 in. sq. with test 3. It is believed that the smaller area pattern of Test 3 is due to the heavier projectiles being more capable of resisting wind drag. The pattern at 20 ft. was 818.5 in. sq. for Test 2B versus 195.4 in. sq. for Test 3. It is believed that the thicker projectiles 150 are more capable of resisting wind drag, perhaps resulting in less tumbling of projectiles 150 in flight, thereby creating a smaller pattern area. It is also believed that projectile 150 mass is a key variable in tine-tuning the distance at which a stack of projectiles 150 break apart to begin individual flight.

Test 4 shows the effect of gunpowder 130 charge on pattern formation in comparison to Test 2B. Test 2B showed a velocity of 923.8 fps versus 911.6 feet per second for Test 4, which is within the limits of normal variation. The pattern at 10 ft. was 21.0 in. sq. for Test 2B, versus 22.6 in. sq. for Test 4. This is also believed to be within the limits of normal variation. At 20 ft., the pattern for Test 2B was at 818.5 in. sq. versus 231.4 in. sq. for Test 4. It was originally anticipated that there would be a slower velocity with the lower gunpowder 130 charge, resulting in a smaller area pattern at 20 ft. However, the velocity of the stack of projectiles is within normal variation for Test 2B and Test 4. Upon analysis of the test, the inventors believe the reduced charge of gunpowder 130 resulted in less volume to fill the case 120, creating more "head space". This may have resulted in a "cushioned acceleration" of the stack of projectiles 150 which, in turn, formed a more cohesive stack prior to the projectiles breaking apart to take on individual flight. This is a surprising result.

It should be noted that one sample from Test 2A, and one sample from Test 2B were selected to test depth of penetration (in inches) at a range of 5 ft. in 10% gelatin. Test 2A had one round of ammunition 100 fired into 10% gelatin at 5'. The pattern area was approximately 1 in. sq. with the furthest penetrating projectile 150 achieving a depth of 4 inches. In Test 2B, the depth of penetration at 20' was measured. Two projectiles 150 penetrated equally at a depth of about 2 inches. These results indicate that the projectiles 150 can be made to decelerate based on the geometry of the projectile 150 and other associated variables.

These data demonstrate the ability to control design parameters which are capable of tight patterns and deep target penetration at a closer distance, and a substantially larger pattern and substantially less deep target penetration at a greater distance.

It is contemplated, and will be clear to those skilled in the art that modifications and/or changes may be made to the embodiments of the disclosure. Accordingly, the foregoing description and the accompanying drawings are intended to be illustrative of the example embodiments only and not limiting thereto, in which the true spirit and scope of the present disclosure is determined by reference to the appended claims.

What is claimed is:

1. A round of ammunition comprising:

a. a cylindrical case having forward and rearward ends;

b. a primer located at the rearward end of the case;

c. a shaped and contoured tip located at the forward end of the case;

d. a predetermined amount of gunpowder located within the case adjacent to the primer;

e. a wad in the form of a custom-shaped disk, located within the case adjacent to the gunpowder;

f. more than one projectiles formed in a stack, wherein at least one of said projectiles has a thickness, a diameter, a centerline, and a center of mass, and wherein the center of mass is offset from the centerline by a predetermined amount;

wherein the wad and tip hold the stack in position within the cylindrical case.

2. The round of ammunition of claim 1, wherein the surface of at least one of the projectiles is textured.

3. The round of ammunition of claim 1, wherein the projectile has a three-dimensional center of mass offset from the centerline by at least 15% of a diameter of the projectile.

4. The round of ammunition of claim 1, wherein at least one of the projectiles is tapered.

5. The round of ammunition of claim 1, wherein the projectile includes a hole.

6. The round of ammunition of claim 1, wherein at least one of the projectiles has a texture on at least one surface.

7. The round of ammunition of claim 1, wherein the tip has a base, and wherein the base is textured.

8. The round of ammunition of claim 1, wherein the tip has a tip cavity.

9. The round of ammunition of claim 1, wherein the round of ammunition includes a marking powder within the tip.

10. A plurality of projectiles for use in a round of ammunition, the projectiles having a thickness, a diameter, a centerline, and a center of mass, wherein the center of mass is offset from the centerline by at least 15% of the diameter; and the projectiles having non-identical shape.

11. The projectiles of claim 10, further comprising at least one of the projectiles having a hole that is offset from the centerline.

12. The projectiles of claim 10, wherein at least one of the projectiles is tapered.

13. The projectiles of claim 10, wherein at least one surface on at least one of the projectiles is textured.

14. A round of ammunition comprising:

a. a cylindrical case having forward and rearward ends;

b. a primer located at the rearward end of the case;

c. a tip comprising a nose, a cylinder, and a base;

d. a predetermined amount of gunpowder located within the case adjacent to the primer;

e. a wad in the form of a custom-shaped disk, located within the case adjacent to the gunpowder;

f. more than one projectiles formed in a stack, wherein each projectile has an offset center of mass; and g. upon discharge from a weapon, the projectiles will be subject to a varying flight path;

wherein the wad and tip hold the stack in position within the cylindrical case.

15. The round of claim 1, wherein upon discharge from a weapon, the various projectiles separate from the stack and take on separate flight paths according to predetermined characteristics.

16. The plurality of projectiles of claim 10, wherein upon discharge from a weapon, the various projectiles separate from the stack and take on separate flight paths according to predetermined characteristics.

17. The round of claim 14, wherein upon discharge from a weapon, the various projectiles separate from the stack and take on separate flight paths according to predetermined characteristics.

18. The round of claim 1, wherein various of the projectiles are non-identical in shape.

19. The round of claim 14, wherein various of the projectiles are non-identical in shape.

* * * * *